US005090932A

United States Patent [19]

Dieumegard et al.

[11] Patent Number: 5,090,932

[45] Date of Patent: Feb. 25, 1992

[54] METHOD FOR THE FABRICATION OF FIELD EMISSION TYPE SOURCES, AND APPLICATION THEREOF TO THE MAKING OF ARRAYS OF EMITTERS

[75] Inventors: Dominique Dieumegard, Mareil-Marly; Guy Garry, Rueil Malmaison; Léonidas Karapiperis, Bourg la Reine; Didier Pribat, Paris; Christian Collet, Limours, all of France

[73] Assignee: Thomson-CSF, Puteaux, France

[21] Appl. No.: 439,372

[22] PCT Filed: Mar. 24, 1989

[86] PCT No.: PCT/FR89/00142

§ 371 Date: Nov. 16, 1989

§ 102(e) Date: Nov. 16, 1989

[87] PCT Pub. No.: WO89/09479

PCT Pub. Date: Oct. 5, 1989

[30] Foreign Application Priority Data

Mar. 25, 1988 [FR] France ..... 88 03949
Mar. 10, 1989 [FR] France ..... 89 03153

[51] Int. Cl.[5] ..... H01J 9/02

[52] U.S. Cl. ..... 445/24; 445/49; 437/89; 437/93

[58] Field of Search ..... 445/24, 49, 50; 156/612, 613; 437/93, 89, 970; 148/DIG. 29, DIG. 73, DIG. 169

[56] References Cited

U.S. PATENT DOCUMENTS

| | | | |
|---|---|---|---|
| 3,497,929 | 3/1970 | Shoulders et al. | 445/52 |
| 3,620,833 | 11/1971 | Gleim | 437/62 |
| 3,789,471 | 2/1974 | Spindt et al. | 445/52 |
| 3,812,559 | 5/1974 | Spindt et al. | 445/52 |
| 3,900,863 | 8/1975 | Kim | 357/60 |
| 4,008,412 | 2/1977 | Yuito . | |
| 4,307,507 | 12/1981 | Gray . | |
| 4,652,077 | 3/1987 | Erman et al. | 357/60 |

FOREIGN PATENT DOCUMENTS

| | | |
|---|---|---|
| 0130650 | 1/1985 | European Pat. Off. . |
| 0278405 | 8/1988 | European Pat. Off. . |

OTHER PUBLICATIONS

Extended Abstracts, vol. 86, No. 1, May 1986, H. H. Busta et al: "Micromachined tungsten field emitters", pp. 403–404.

*Primary Examiner*—Kenneth J. Ramsey
*Attorney, Agent, or Firm*—Oblon, Spivak, McClelland, Maier & Neustadt

[57] ABSTRACT

Disclosed is a method for the fabrication of field emission peaks using a monocrystalline substrate with a suitable orientation coated with an insulating layer where square-shaped elementary zones with a suitable orientation with respect to the substrate have been removed. Silicon is deposited by selective epitaxy in these zones. The epitaxial growth of silicon, at high speed parallel to the substrate and at low speed along faces of the substrate at 45° to the substrate, enables the making of pyramidal peaks which, afater being coated with tungsten, form emitting peaks.

34 Claims, 7 Drawing Sheets

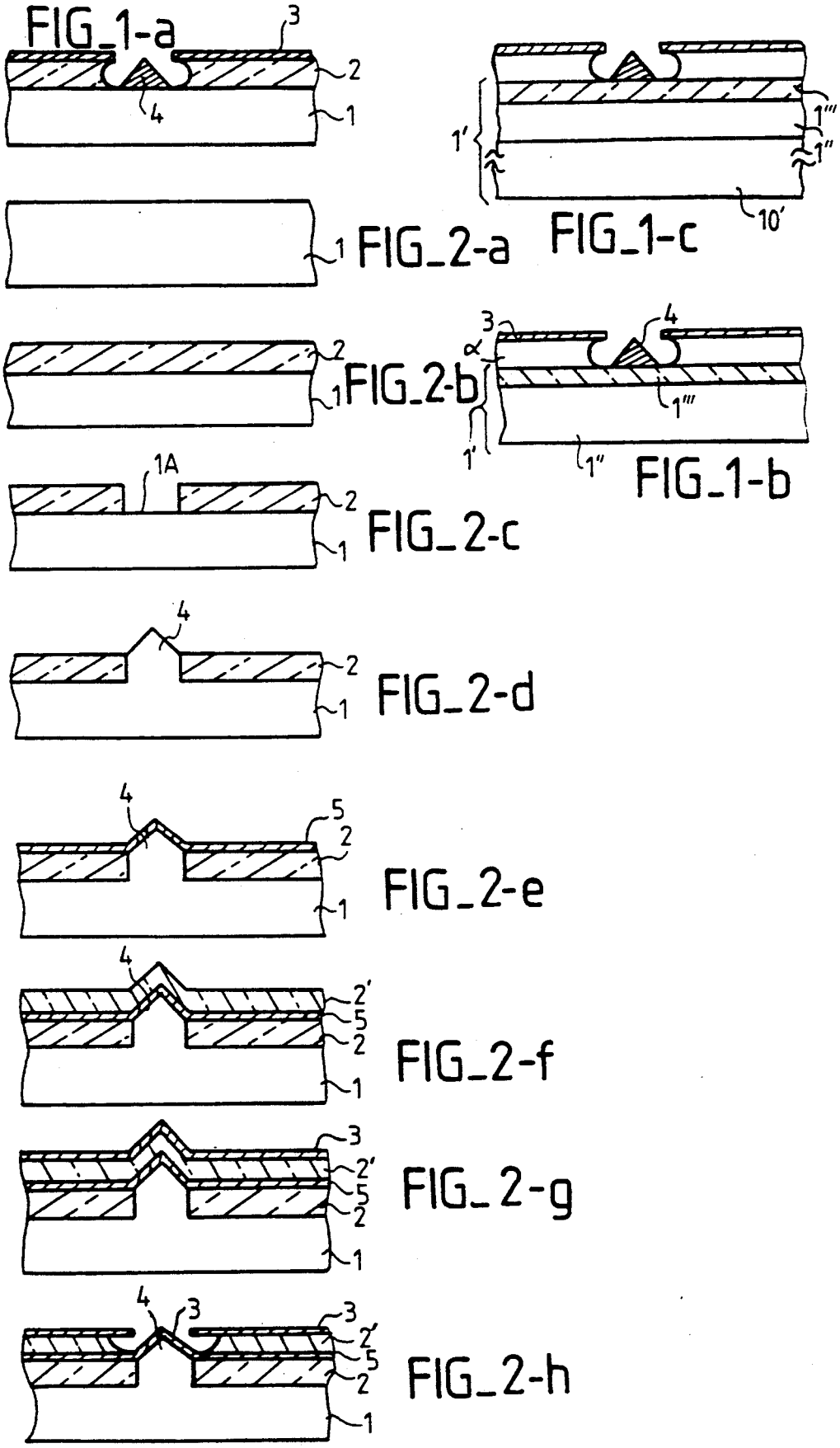
FIG_1-a
3
2
4
1
1'
1'''
1''
10'
FIG_1-c
1
FIG_2-a
2
1
FIG_2-b
3
4
α
1'''
1'
1''
FIG_1-b
1A
2
1
FIG_2-c
4
2
1
FIG_2-d
4
5
2
1
FIG_2-e
4
2'
5
2
1
FIG_2-f
3
2'
5
2
1
FIG_2-g
4
3
3
2'
5
2
1
FIG_2-h

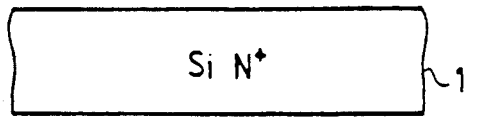
FIG_3-a
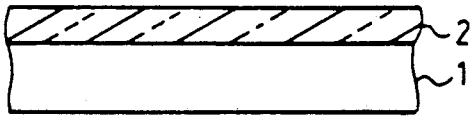
FIG_3-b
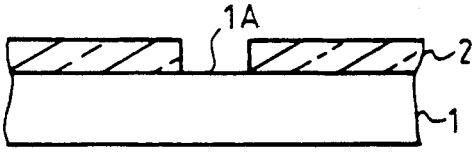
FIG_3-c
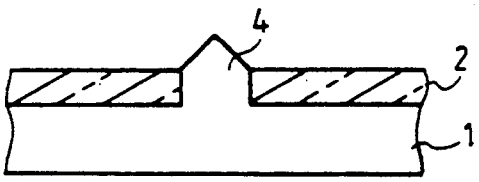
FIG_3-d
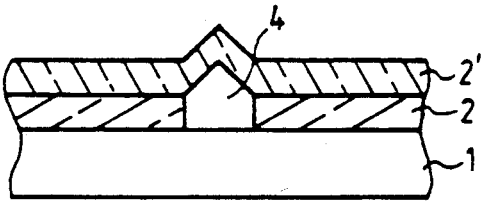
FIG_3-e
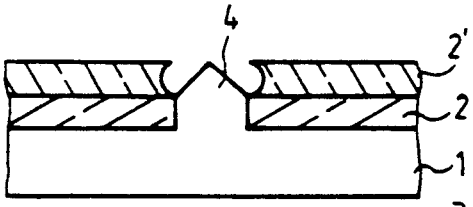
FIG_3-f
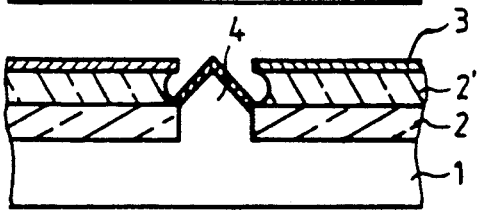
FIG_3-g
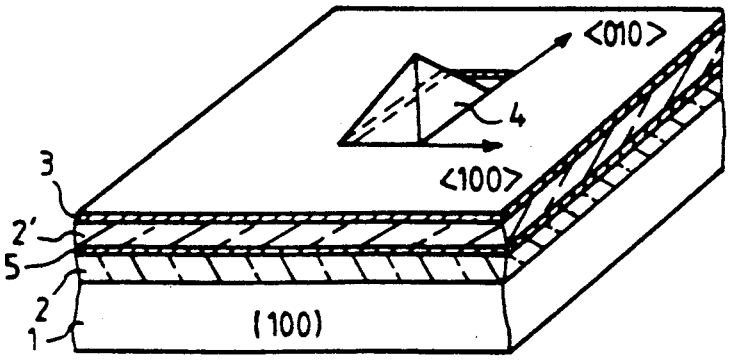
FIG_4

FIG_12
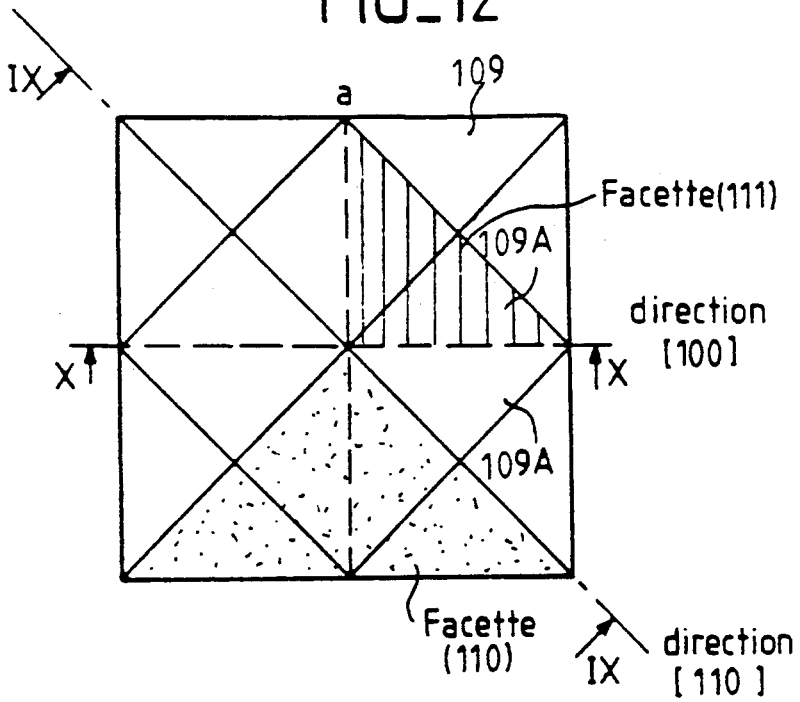
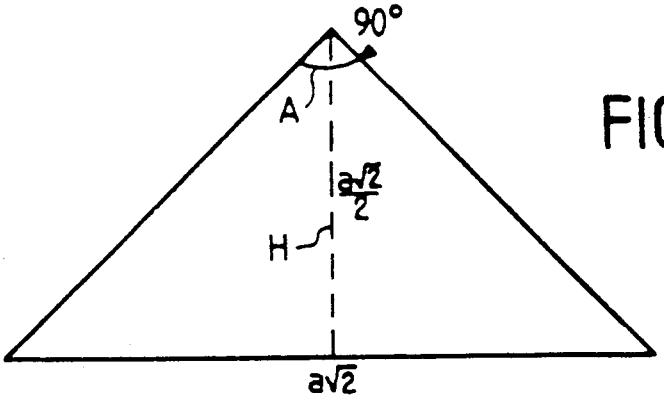
FIG_13
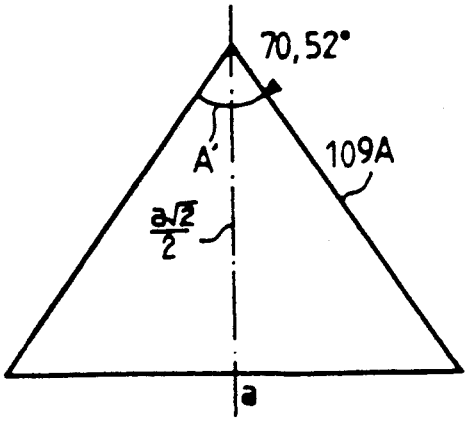
FIG_14

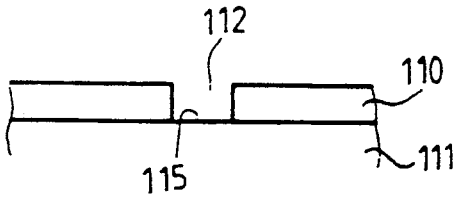
FIG_15
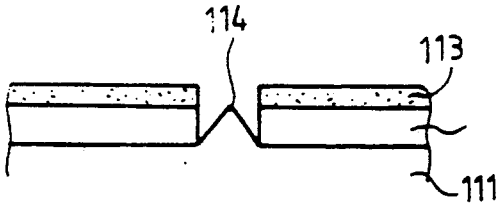
FIG_16
FIG_17
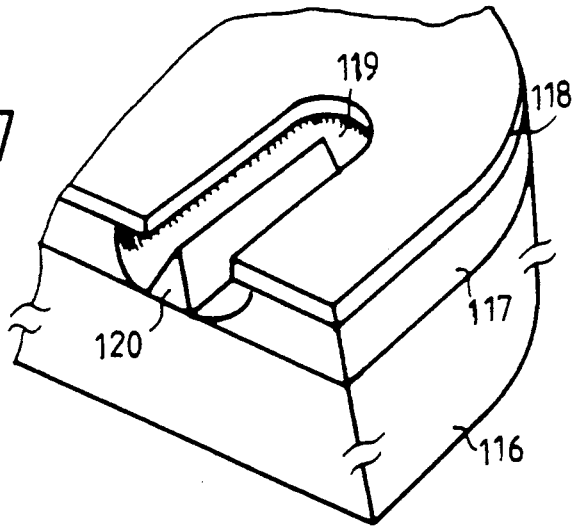
FIG_18
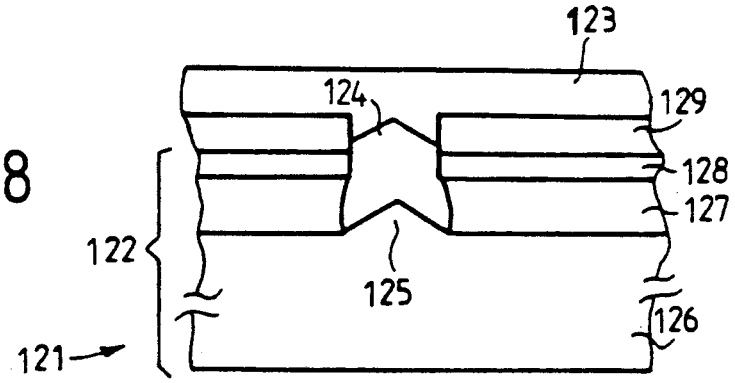

FIG_19-a
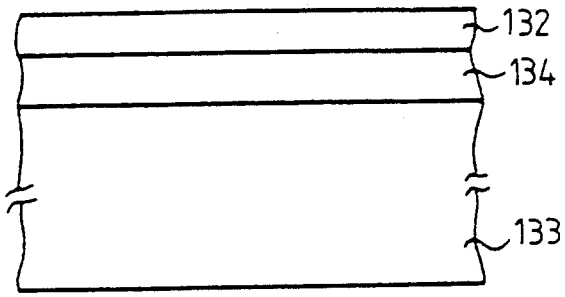
FIG_19-b
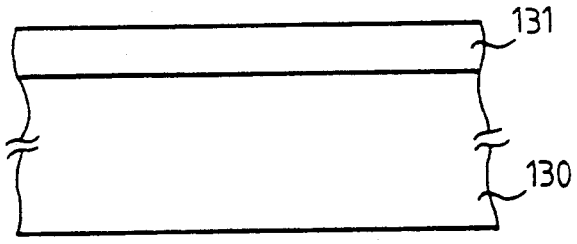
FIG_20
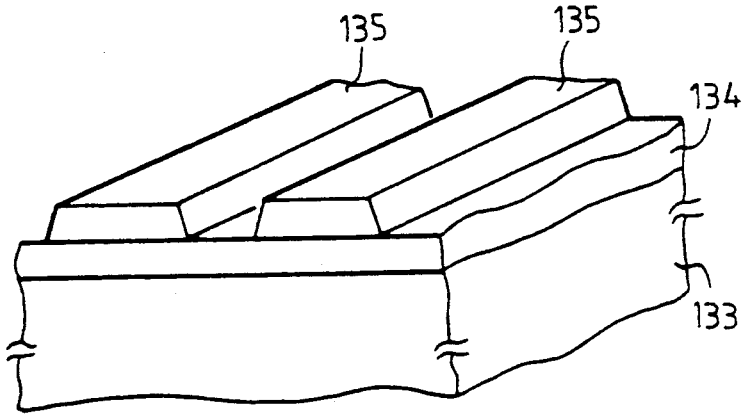
FIG_21
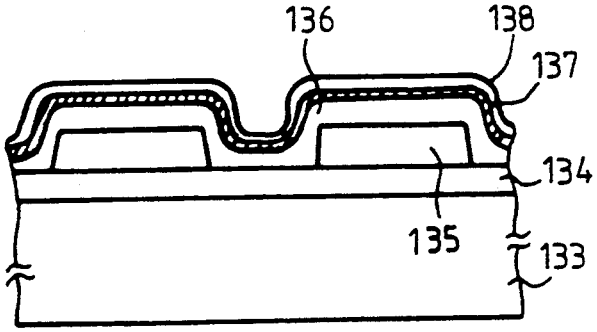

METHOD FOR THE FABRICATION OF FIELD EMISSION TYPE SOURCES, AND APPLICATION THEREOF TO THE MAKING OF ARRAYS OF EMITTERS

BACKGROUND OF THE INVENTION

1. Field of the Invention

The invention relates to the fabrication of field emission type electron sources and, more particularly, to a method for the fabrication of peak emitters which can be used in dense arrays of sources of this type, and is applicable notably to triode systems or to display screens.

2. Description of the Prior Art

For the fabrication of two-dimensional arrays of field emitters, the electron source is generally formed by a metallic emitter cone deposited on a substrate, surrounded by an insulating cavity formed in a thin dielectrical layer, said layer comprising, in its upper part, a thin metallic layer forming the extraction electrode. This micro-emitter is made repetitively on the substrate with a density of the order of $10^6$ emitters per $cm^2$. The micro-emitters may be grouped in elementary cells, for example of the order of $10^3$ emitters or more per $cm^2$, with each cell forming an emission area located at the node of a matrix network of rows of cathodes (peaks) and columns of anodes (extraction electrodes).

There are known methods for making field emitters of this type. In a first group of fabrication methods of the type described by C. A. Spindt et al. (for example, in "Journal of Applied Physics," Vol. 47, No. 12, p. 5248, December 1976) after having etched the metallic layer deposited on a layer of dielectric itself lying on a silicon substrate, the dielectric layer is etched by ionic or chemical etching, and then a thin layer is deposited on the substrate in all the holes thus formed in the dielectric layer, the sample rotating on the axis of the hole so that a cone-shaped deposit is achieved. Owing to the rotation, it is not possible to process a large number of samples simultaneously.

Another method to make peaks has been described in the prior art: this method applies a chemical etching process by the attacking of a monocrystalline substrate along preferred planes. This technique requires highly rigorous control of the chemical attacking process if it is desired to minimize the formation of "unwanted peaks" due to non-homogeneity in etching.

The prior art methods thus do not enable the simple making of an array of peak emitters.

An object of the invention is another type of field emitter fabrication method which does not have the drawbacks of the above-mentioned methods.

In particular, an object of the invention is a method for the making of electron sources and field emission cathodes by which it is possible to obtain, in a simple way, cathode peaks which are well centered with respect to the axis of the gate hole, the cathodes being formed by faceted crystalline growth, the electron sources being peaks associated with metallic layers or extractors comprising apertures, in the axis of which these peaks are located.

Another object of the present invention concerns devices using field emission cathodes which have good self-alignment characteristics, the fabrication of which is simplified by the self-alignment method of the invention.

SUMMARY OF THE INVENTION

The method for the fabrication of sources according to the invention consists in making the peaks of these sources by epitaxial and faceted growth of conductive or semi-conductive material on demarcated nucleation zones of the monocrystalline and, at least partially conductive, surface of a support.

The method according to the invention is also characterized by the fact that at least one layer of dielectric material is deposited on a monocrystalline substrate, that at least one cavity is etched in the deposited layer and that a cathode peak is formed at the bottom of each cavity by seeded and faceted crystalline growth on the substrate, a layer of electrically conductive material, which acts as a gate, being formed on the layer of dielectric material.

According to an advantageous aspect of the invention, a layer of dielectric material is deposited on the layer of electrically conductive material, and apertures are etched in the three layers formed on the substrate until the substrate is bared.

The electron source according to the invention comprises, in the order given, a monocrystalline substrate with at least one projecting cathode peak, a dielectric layer and a layer of an electrically conductive material, the peak of the cathode being housed in a cavity, having a section of any shape, made in these two layers and centered with respect to the aperture in the conductive layer.

According to one embodiment of the invention, an electroluminescent component comprises an anode layer made of an electroluminescent material closing the cavity at the bottom of which the cathode peak has been formed.

The components according to the invention may have a matrix structure of rows and columns, each intersection of the matrix having at least one source of electrons as defined above.

BRIEF DESCRIPTION OF THE DRAWINGS

The present invention will be better understood from the following detailed description of an embodiment, taken as a non-descriptive example and illustrated by the appended drawings, of which:

FIGS. 1A, 1C and 1B show a general structure of a peak emitter;

FIGS. 2*a* to 2*h* show different steps of a first variant of the field emitter fabrication method according to the invention;

FIGS. 3*a* to 3*g* show different steps of a second variant of the field emission emitter fabrication method according the invention;

FIG. 4 is a view in perspective of the elementary structure obtained according to the invention;

FIGS. 12 to 14 show schematic views illustrating a selective, chemical attacking step, by which it is possible to obtain a determined faceting, according to the method of the invention;

FIGS. 15 and 16 are simplified views illustrating a variant of the method according to the invention;

FIG. 17 shows a simplified view in perspective sectional view of an alternative electron source according to the invention;

FIG. 18 shows a schematic sectional view of an electroluminescent element comprising an electron source according to the invention, and, FIGS. 19*a* to 23 are schematic views illustrating steps in the fabrication of the component according to the invention.

DESCRIPTION OF PREFERRED EMBODIMENTS

The structure of an elementary emitter is shown in FIG. 1A: a monocrystalline substrate 1, made of an electrically conductive material (metal or semiconductor), bears an insulating layer 2 coated with a conductive thin layer 3. A hole prepared in the insulating layer 2 and metallic layer 3 enables the making of a conductive peak 4, lying on the substrate, for the emission of electrons during the application of a potential between the peak 4 (cathode) and the conductive upper layer 3 (gate).

The structure of FIG. 1B differs from that of FIG. 1A in that the substrate 1' has a support 1'' made of an insulating material coated with an epitaxiated layer 1''' made of an electrically conductive material. The layer 1''' may itself lie on a support of a different type 10' (see FIG. 1C).

Figure 5:
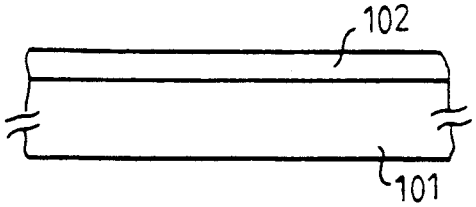
FIGS. 5 to 11 show schematic sectional views illustrating different successive steps of the method according to the invention.

The fabrication method according to the invention proceeds by selective epitaxy on a substrate of silicon or of any other appropriate monocrystalline or conductive material, rather than by deposition of metal or by chemical etching of silicon, as shown in FIGS. 2*a* to 2*h* and FIGS. 3*a* to 3*g* where the same elements as those of FIG. 5 have been designated by the same references.

For this, the initial substrate 1 is typically a substrate of monocrystalline silicon with an orientation (100), the dimensions of which may be 100 to 150 mm or more, and the resistivity of which is $10^{-3}$ ohm.cm to a few ohm-cm. This substrate is shown in FIG. 2*a* and FIG. 3*a*.

The first step of the method in both variants consists in oxidizing the surface of the substrate by thermal oxidation of the silicon to obtain an appropriate thickness of silica $SiO_2$, which is generally smaller than 1 μm but which, nonetheless, can be greater. It is thus possible to obtain this silica layer by any other appropriate method of deposition: vacuum evaporation, cathode sputtering or CVD process such as: PECVD (Plasma Enhanced Chemical Vapor Deposition), LTO (Low Temperature Oxide) or HTO (High Temperature Oxide), etc. The monocrystalline substrate 1, provided with its insulating layer of silica 2, is shown in FIGS. 2*b* and 3*b*.

The second step of the method consists in etching this silica layer in the zones where the peaks have to be formed. For this, an initial deposition is made of a uniform layer of resin which is sensitive to light, X-rays, electrons or ions and has a thickness that depends on the isolation method used. This uniform layer of resin is then exposed through a mask for a layer sensitive to light or to X-rays, or it is isolated by direct writing by means of an electron beam or an ion beam to obtain the desired pattern of elementary figures. Each elementary figure is an elementary zone which is suitably oriented with respect to the crystallographic directions of the substrate. In the present case, each elementary figures is a square, the sides of which are parallel to the directions <100> or <110> of the substrate and have a length ranging from a fraction of a micrometer to a few micrometers. The pitch of the system of elementary figures ranges from a few micrometers to several tens of micrometers. The resin is then developed and the silica layer 2 is attacked, either by chemical attack or, preferably, by RIE (Reactive Ion Etching) in the apertures thus formed in the resin layer. These apertures having been made, the resin is then removed. The corresponding structure is shown in FIGS. 2*c* and 3*c*.

The following stage is the stage in which the silicon peaks 4 are made. For this, in the windows opened in the silica layer, pyramids forming the peaks are made on the bared zones 1A of the substrate 1, by faceted, selective epitaxy of silicon. This epitaxy is called selective because there is no deposition on the surface of the silica 2 but only on the bottom of the aperture window, which is formed by monocrystalline silicon with an orientation <100> and acts as a seed for the crystalline growth. Furthermore, the operating conditions of growth are chosen so that an optimum faceting is developed. These facets are oriented by 45° or by 54.74° with respect to the surface of the substrate, and are facets with slow growth speed, the plane of the substrate being the plane of high-speed growth. Thus, by epitaxy from a square, elementary zone etched on the silica surface, pyramidal peaks 4, shown in FIGS. 2*d* and 3*d*, are obtained. The selective epitaxy of silicon can be done either at atmospheric pressure or at reduced pressure. At atmospheric pressure, the optimum gas mixture is a mixture of silane $SiH_4$, hydrogen $H_2$, and hydrochloric acid HCl, at a temperature ranging between 1000° C. and 1100° C. At reduced pressure, the optimum gas mixture may be formed by dichlorosilane $SiH_2Cl_2$, hydrogen $H_2$ and hydrochloric acid HCl, at a temperature ranging from 850° to 950° C. From this stage of epitaxy onwards, two variants are possible.

In the variant shown in FIGS. 2*e* to 2*f*, the following stage is a stage of metallic deposition on the surface of the silica and of the silicon peaks. This uniform, metallic thin layer 5, with a thickness of less than 1 μm, is deposited by evaporation, sputtering or vapor phase epitaxy. It may be advantageously formed by tungsten, which is a good emitter of electrons.

Then, in a following stage, a uniform, thin layer of dielectric 2' is deposited on the metallic layer. This layer may be a layer of silica, like the layer 2, or a layer of silicon nitride or, again, a layer of alumina. The thickness of this layer will be of the order of 1 to a few microns.

The next stage, then, is that of the deposition of a second uniform, metallic, thin layer with a thickness of less than 1 μm, deposited by the same techniques as above, i.e. by evaporation, or by sputtering, or by chemical vapor deposition. This second layer of metal is designed to form the extracting electrode, namely the gate. What remains to be done, then, is to remove the second layer of metal and the layer of dielectric on the peak forming the cathode 4 of the emitter.

To this end, the following stage is a stage for the uniform deposition of masking resin, as in the stage where the apertures were formed in the layer of silica, this resin being sensitive to light, to X-rays, to electrons or to ions. A masking stage, using the same mask as the one used to etch the silica layer, enables, in the following stage after the development of the resin, to make a selective attacking of the second, metallic thin layer and then to remove the dielectric layer to reveal the peak 4, covered with the first metallic, thin layer. This attacking may be done chemically. The final structure, after the attacking of the metal layer and the dielectric layer, is shown in FIG. 2*h*.

The pitch between elementary emitters is such that the system needed to control these emitters can be made in the intervals between elementary emitters, by etching of metallic, thin layers. These metallic layers may be formed by tungsten, which is especially suited to the extraction of electrons and which does not get eroded under the effect of the electrons.

In the second variant of the fabrication method, after the stage for growth by selective epitaxy of silicon in the zones where the silica layer has been removed, as shown in FIG. 3*d*, the procedure moves directly to a stage for the deposition of a dielectric layer 2' on the set formed by the silica layer and the silicon peaks, without prior deposition of the metallic, thin film. This dielectric layer 2', shown in FIG. 3*e*, is formed by a material which may be different from silica so that, during the subsequent cutting out of the dielectric, the cutting-out operation does not affect the underlying silica layer 2. However, this is not absolutely necessary, for the attacking operation around the pedestal of the peak of dielectric material is not a problem in itself.

The following stage, which enables the cutting out of the dielectric 2', consists in making a resin deposition, in insolating it through a mask and developing it, and then making a localized attack of the dielectric in the zones where the resin has been removed. The structure at the end of this stage is shown in FIG. 3*f*.

The last stage of the method consists in the deposition of a metallic, thin film which, owing to the structure obtained at the end of the previous stage, will enable the deposition of the metal both on the plane surface to form the gate 3 of the emitter and on the silicon peaks 4 to form the emitting cathode.

In this variant of the method, the cathodes of the peak emitters are not connected to one another by a plane, metallic layer, and the connections as well as the supply of electrons to these peaks of emitters should also be done. In this case, the initial substrate is preferably a substrate that is highly N+ doped so as to convey the electrons to the metallic peaks made of tungsten for example.

FIG. 4 is a view in perspective, showing the facets of a peak of an emitter made according to the first variant of the method.

The making of the connections and arrays of electrodes needed to form the elementary cells, and then matrix network of cathode rows and gate columns, for example to form a display screen, shall be described in detail below. However, it can be seen from the above description that the method, according to the invention, for the fabrication of peak emitters, is particularly well suited to the making of arrays of emitters since it uses only fabrication stages in which several samples are processed simultaneously in the same epitaxial chamber without its being necessary for each sample to be in rotation: the requisite conditions for the method to be applied properly are that the monocrystalline substrate on which the silicon is made to grow by selective epitaxy should be oriented suitably, and that a faceted pyramid is readily obtained during growth, the gas mixture used during the epitaxy having the proportion of hydrochloric acid and $SiH_4$ or adapted $SiH_2Cl_2$.

Another variant of the method to make the source according to the invention starts with a monocrystalline substrate 101. The substrate 101 is, for example, made of Si or GaAs or any other suitable monocrystalline material. This substrate 101 has a surface orientation (x, y, z), x, y and z being any whole numbers. Preferably, but non-restrictively, these whole numbers are equal to 0 or to 1: this corresponds to faces such as (100), (110) or (111), which are easily accessible. It is also possible to use oriented substrates (211), (221) or (311).

The first step of the method of the invention (FIG. 5) consists in depositing a dielectric layer 102 on the substrate 101. This dielectric is, for example, $SiO_2$ or $Si_3N_4$, and its thickness is advantageously about 1 to 2 microns. This deposition can be done by prior art methods such as pyrolysis of a gas mixture $SiH_4+N_2O$ or $SiH_4+NH_3$ at a temperature of about 850° C., or plasma enhanced deposition at a temperature of about 250° C.

Figure 6:
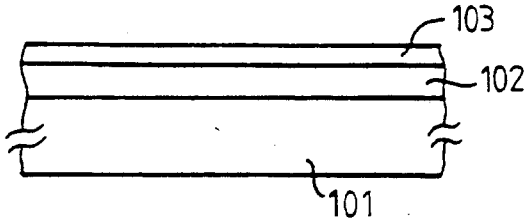

The second step (FIG. 6) consists in the deposition of a metallic layer 103 used as an extraction gate metallization. The thickness of the layer 103 is, for example, about 0.1 to 1 micron. The deposited material is advantageously Mo, Pt or Mi.

Figure 7:
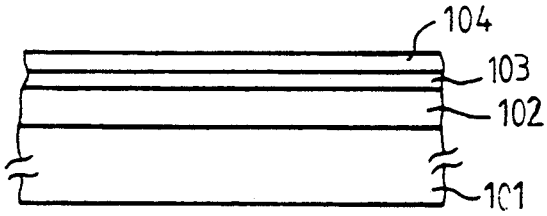

The third step (FIG. 7) consists in the deposition of a passivating layer 104 of dielectric material. This layer 104 enables preventing the nucleation of polycrystalline material (for example Si) on the gate 103 metallic layer during the faceted epitaxial operation, and thus enables this epitaxial operation (described below with reference to FIG. 10) to be made effectively selective. The material of the layer 104 should be different from that of the layer 102 in order to enable selective removal, by chemical attack, of this layer 104 during the seventh step described below. If, for example, the layer 102 is made of $Si_3N_4$, the layer 104 may be made of $SiO_2$, and if the layer 102 is made of $SiO_2$, the layer 104 may be made of $Si_3N_4$. The thickness of the layer 104 is, for example, about 0.1 to 1 micron.

The fourth step (FIG. 8) consists in making an etching of a cavity 105 in the layers 102 to 104 to bare a surface 106 of the substrate 101. The surface 106 may have any shape and dimensions. The invention is especially advantageous when it is necessary to make a network of microcathodes with very small pitches (with the cavities 105 having a characteristic diameter or dimension of the order of 0.5 to 2 microns and a repetition pitch of the order of 10 microns at least), especially because it is possible, for doing the etching of the cavities 105, to use a mask (not shown) of photosensitive resin deposited on the layer 104 and appropriately insolated to define the apertures (of any shape) of the cavities 104. The etching is then done by RIE ("Reactive Ion Etching"). This enables a self-alignment of the peak of each cathode with reference to the aperture of the corresponding gate as shall be seen from the following description.

The fifth step (FIG. 9), which is not necessarily implemented in all cases, consists in increasing the section of the cavity 105 in the layer 102 by a slight chemical attack. A cavity 107 is obtained in this layer 102, and this cavity 107 leaves bare a surface 108 on the substrate 101. Advantageously, if the layer 102 is made of $SiO_2$, this attack is done with HF.

The sixth step (FIG. 10) consists in making a pyramid 109 grow, under conditions of faceted, selective epitaxy, on the surface 108, which acts as a crystallization seed (or on the surface 106 if step 5 is not proceeded with). This selectivity of the deposition (deposition solely on the surface 108 or 106) is obtained, for example, when the substrate and the deposition material are silicon, by using an atmospheric pressure or reduced pressure chemical vapor deposition (CVD) reactor, wherein there is introduced a gas mixture with well-defined proportions comprising, for example, $SiH_4+HCl$ or $SiH_2Cl_2+HCl$ (CHECK) emitted in carrier $H_2$, at a temperature ranging between 900° C. and 1100° C. approximately (see for example, article by L. KARAPIPERIS et al. published in "Proceedings of the Eighteenth International Conference on Solid State Devices and Materials", Tokyo 1986, page 713). In the case of gallium arsenide, the selectivity of the deposition can be obtained by using a VPE (vapor phase epitaxy) type of reactor at a temperature ranging from 600° C. to 800° C. approximately, by the method of chlorides (for example, $AsCl_3$ diluted in $H_2$ and a source of solid gallium). It is also possible to use a reduced pressure MOCVD (metal organic chemical vapor deposition) type of method. For more details on these different methods of selective deposition, we might refer, for example, to the French patent application No. 88 04437. The above-mentioned conditions of reaction and the partial pressures of the various gases used are adjusted according to the orientation of the substrate, so as to preferably obtain a faceting (111) on all four faces of the pyramid 9. This faceting corresponds to an angle of about 70° at the vertex of the pyramid, and this is favorable to field emission.

It is also possible to use selective deposition of tungsten W which also makes it possible to make the peaks grow only on the seeds of monocrystalline substrate released by attacking the dielectric 104, of the metallic layer 103 and of the other dielectric 102 (see for example, I. BEINGLASS, P. A. GARCINI, extended abstract 380, ECS Fall Meeting, Denver Colo., October 1981, for details of this method).

The decomposition reaction takes place in a low pressure CVD type reactor using $WF_6$ diluted in $H_2$ at a temperature of about 600° C. or more. It is necessary to properly control the deposition speed, the temperature and the size of the nucleation apertures in order to obtain faceted growth.

Figure 11:
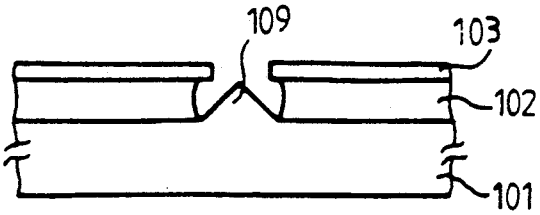

The seventh step (FIG. 11) which is not necessarily implemented consists in removing the layer 104 of dielectric material, advantageously by selective chemical attack.

Should the faceting obtained by selective growth give no planes (111) for the four faces of the pyramid 109 (FIGS. 10, 11), the invention provides for an additional step of selective chemical attacking used to obtain this faceting.

For example (see FIG. 12), if a substrate of silicon with a surface orientation of (100) is used, and if a deposition is made from a mixture of $SiH_4+HCl$ in $H_2$ at about 1060° C. approximately, it is easy to obtain a faceting (110) of the pyramid 109: this corresponds to an angle of 90° at the vertex A (FIG. 13). However, from the viewpoint of field emission, it is preferable to obtain a pyramid with an angle of less than 90° at the vertex. Thus, for this example of FIG. 12, after deposition, a hydroxide ions (for example KOH or NaOH) based attacking solution is used at a temperature ranging from 25° C. to 80° C. approximately. This type of solution has, in effect, the particular feature of attacking the silicon crystal much faster (100 to 1000 times faster) in the directions <100> or <110> than in the directions <111> (see for example, article by K. E. BEAN in IEEE Transactions on Electron Devices, ED-25 10, 1185, 1978). Thus, for the above-mentioned example (FIG. 12), the structure limited by the plane (110) disappears and is replaced by a structure 109A limited by planes (111) passing through the vertex of the pyramid. It is not necessary to perform an additional masking operation. The height H of the pyramid remains unchanged but the dimensions of its base are reduced. We go from a pyramid 109 with an angle of 90° at the vertex A to a pyramid 109A with an angle of about 70° at the vertex A' (FIG. 14).

To achieve the chemical attacking of the pyramid 109, it is also possible to use a solution based on ethylenediamine (EDA), pyrocatechol and water and to perform the operation at about 100° C. Thus, excellent selectivity is obtained in the attacking speeds along the crystallographic directions mentioned above.

We shall now describe a variant of the method of the invention, with reference to FIGS. 15 and 16.

As described above, the first step consists in depositing a layer 110 of dielectric material on a substrate 111 made of monocrystalline material. The second step (FIG. 15) consists in the etching of a cavity 112, by RIE, in the layer 110.

The third step consists in directly depositing, without setting up conditions of selectivity, the polycrystalline material 113 on the dielectric 110, and the faceted monocrystalline material 114 on the surface 115 of the substrate bared by etching the cavity 112, said material 114 forming a pyramid. So that the layer 113 may be made of a material that is a good conductor, and so that it can act as a gate, it is very highly doped during the deposition stage. If a substrate 111 is made of silicon, the deposition is done by using a parent gas phase made of $SiH_4$ diluted in a carrier gas ($H_2$ or He for example). To reduce the deposition speed of polycrystal on the silica 110 (so that there is no layer 113 which is too thick, when the pyramid 114 is completed), it is possible to add HCl in the gas phase, but in a controlled quantity so as not to inhibit the nucleation of the polysilicon 113 on the silica 110. Preferably, the dopant gas is then phosphine $PH_3$, so as to obtain n type highly doped silicon both at the monocrystalline pyramid and at the polycrystalline deposit 113 on the silica 110. The advantage of this variant it that the micro-peak and the gate are obtained directly during the same operation.

FIG. 17 shows a possible embodiment of an electron source according to the invention. For this embodiment, the source is formed on a monocrystalline substrate 116 on which a dielectric layer 117 and then a gate conductive layer 118 are deposited. The cavity 119, etched in the layers 117, 118, has an oblong shape, thus making the cathode 120 have an elongated prism shape.

It is quite clear that the cavities made in the layers 102, 103, 104 (FIG. 8) or in the layer 110 (FIG. 15) may have any surface shape, the sides of which may or may not be aligned with particular axes of the plane of the substrate. In particular, if the substrate is made of GaAs, because of the anistropy of growth, it will be seen to it that the general axis of the apertures will be oriented in a direction enabling optimum faceting such as (111) for example, or else even higher indices such as (221) or (331).

The electron source according to the invention may be used alone or in an system of microsources to achieve very different devices in adding an electron acceleration anode to it and, if necessary, other electrodes. It is thus possible to make electroluminescent devices, microwave components, etc. As a non-restrictive example, FIG. 18 shows an electroluminescent component 121 which has an electron source 122 and an anode 123 made of an electroluminescent material, enclosing the cavity 124 at the bottom of which the cathode peak 125 has been formed. The source 122 has, in the order given, a monocrystalline substrate 126, made of silicon for example, a first dielectric layer 127, a metallic gate layer 128 and a second dielectric layer 129 which may be the above-mentioned passivation layer. The anode layer 123 is deposited under high vacuum on the layer 129, for example as described in co-pending U.S. patent application Ser. No. 377,090, filed in the name of Pribat et al on July 7, 1989.

We shall now describe a method enabling the achievement of a matrix addressing of each micro-peak or group of micro-peaks.

The method starts with a monocrystalline insulating substrate 130 on which a conducting or semiconducting material 131 (FIG. 19B) is hetero-epitaxiated. It is possible, for example, to use a material such as silicon hetero-epitaxiated on sapphire (or SOS for silicon on sapphire) or else silicon hetero-eptiaxiated on yttria stabilized zirconia (YSZ) or else, again, silicon hetero-epitaxiated on spinel ($Mg\ Al_2\ O_4$) or any other known composite substrate known to those skilled in the art. The layer of hetero-epitaxiated silicon will have a typical thickness of a few microns to about 100 microns. This silicon will also be highly n doped so as to have resistivity of some $10^{-3}$ ohm.cm.

Advantageously, it is possible to use an initial structure shown in FIG. 19A of the SIMOX (Silicon Insulation by IMplantation of OXygen) wherein the silicon of the thin layer 132 is insulated from the substrate 133 by a layer 134 formed by ionic implantation of oxygen or nitrogen in very high doses (see for example, article by H. W. Lam. IEEE Circuits and Devices Magazine, July 1987, Vol. 3, No. 4, page 6, for more details on the method). It is also possible to use any method known to those skilled in the art so as to obtain a thin layer of monocrystalline silicon on a dielectric which is not necessarily monocrystalline. It is possible to use a method of recrystallization by energy beam, for example using lamps, lasers or electron beams. It is also possible to use an SDB (silicon direct bonding) type of method where the thin layer is obtained by bonding and thinning. It is also possible to use a method of the forced lateral epitaxy type, etc. All these methods are recalled, for example, in the French patent application 88 16212.

The remaining operations shall be described with reference to a SIMOX type substrate (FIG. 19A), but a substrate of the type shown in FIG. 19B could also be used.

Figure 8:
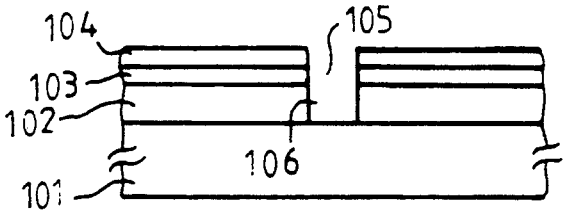
Figure 9:
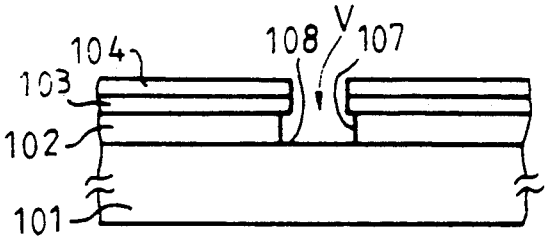
Figure 10:
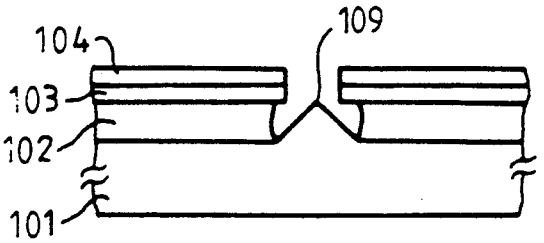
Figure 22:
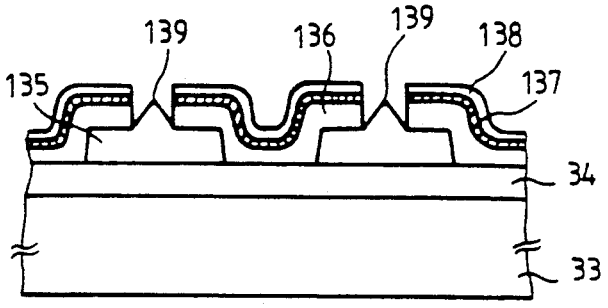

The thin layer of silicon 132 is brought beforehand to a thickness, typically ranging between a few microns and 100 microns, by vapor phase epitaxy. It is also doped during this operation so as to bring its resistivity to some $10^{-3}$ ohm. cm. An etching is then done of bands 135 of silicon, with a typical thickness of the order of the repetition pitch of the peaks, namely about 10 $\mu$m, so as to bare the underlying dielectric $SiO_2$ or $Si_3N_4$ between the bands. These bands are therefore insulated from one another as shown in FIG. 20. Three layers are successively deposited on this structure: a gate dielectric 136, a gate metallization 137 and a passivation dielectric 138 (see FIG. 21). On each previously cut out monocrystalline band 135, there is obtained a structure identical to the one shown in FIG. 7. The sequence of operations shown in FIGS. 8, 9 and 10 is repeated on each monocrystalline band so as to obtain the structure shown in FIG. 22, where rows of micro-peaks 139 have been made to grow on each monocrystalline band 135. Then the unit is coated with photosensitive resin and a resin mask (not shown) is defined, taking the form of bands perpendicular to the bands 135 of monocrystalline silicon defined above. The upper dielectric 138 and the gate metallization 137 are etched so as to mutually insulate the various bands supporting the gate. It is possible to etch the gate dielectric 136 as shown in FIG. 22, but this is nevertheless not necessary.

To obtain electron emission on one peak only, the row j is biased at about 50 volts and the column k is kept at the ground for example, or else the row j is biased at 25 volts and the column k at −25 volts in keeping all the other rows and columns grounded. Only the peak A located at the intersection of the row j and the column k will emit electrons.

Figure 23:
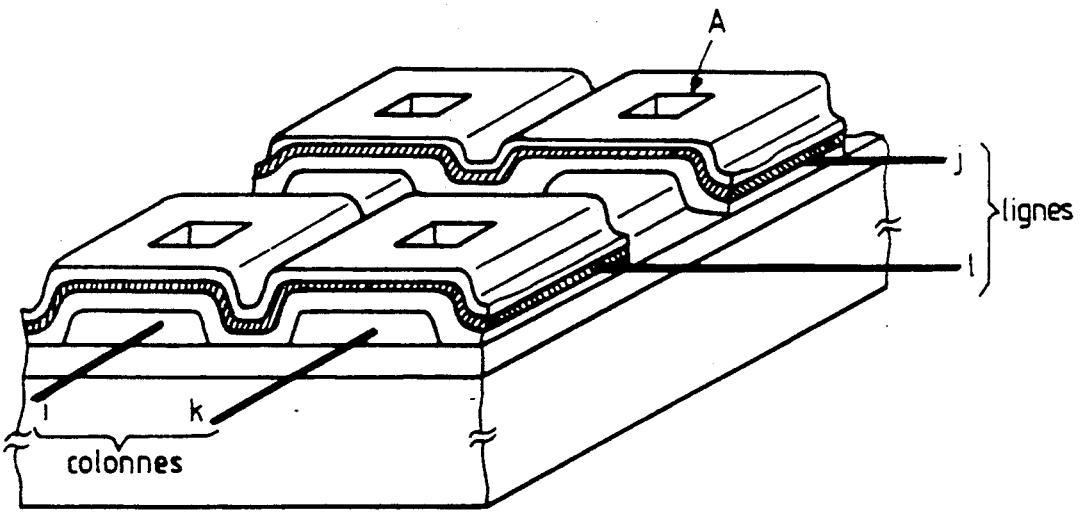

Those skilled in the art will easily find other variants to achieve the structure shown in FIG. 23 in starting from the structure shown in FIGS. 9A or 9B.

What is claimed is:

1. A method for the fabrication of field emission type electron sources, comprising:

forming peaks by epitaxial and faceted growth of conductive or semi-conductive material on demarcated nucleation zones of a surface of a monocrystalline and, at least partially conductive, substrate.

2. A fabrication method according to claim 1, comprising the following steps:

forming a first insulating layer on the surface of the monocrystalline substrate;

selectively removing the first insulating layer to form elementary zones having a predetermined orientation with respect to crystallographic directions of the plane of the substrate;

growing silicon in a faceted, epitaxial manner in the elementary zones of the thus bared substrate, to form the peaks;

depositing a first metallic thin layer and then a second insulating layer, and a second metallic thin layer on the second insulation layer; and removing the second metallic layer and the second insulating layer on the peaks to bare the peaks coated with the first metallic layer forming cathodes, the second metallic layer being capable of being etched to form a network of associated gates.

3. A fabrication method according to claim 1, comprising the following stages:

forming a first insulating layer on a surface of a highly N+ doped monocrystalline layer;

selectively removing the first insulating layer to form square elementary zones with sides having a predetermined orientation with respect to crystallographic axes of the plane of the substrate;

growing metallic or semi-conductive material in a faceted and epitaxial manner in the elementary zones of the thus bared substrate, to form the peaks;

depositing a metallic thin layer on the surface of the metallic or semiconductive material;

depositing a second insulating layer on said metallic thin layer; and removing the second insulating layer on the peaks.

4. A fabrication method according to one of claims 1-3 comprising performing the epitaxial growth using a parent gas phase doped and diluted in a carrier gas.

5. A method according to claim 4, wherein the parent gas phase comprises $SiH_4$ and wherein the carrier gas is $H_2$ or He.

6. A method according to claim 4, wherein HCl is added in the gas phase.

7. A method according to claim 4, wherein the dopant gas is $PH_3$.

8. A fabrication method according to claim 2, comprising forming the first insulating layer by thermally oxidizing the monocrystalline substrate, the first metallic layer being tungsten and the second insulating layer being nitride.

9. A method according to claim 2, comprising depositing at least one of the first and second insulating layers.

10. A method according to claim 9, wherein the deposition is achieved by one of the following methods: evaporation, cathode sputtering or CVD process.

11. A fabrication method according to claim 2, comprising removing the layers in the elementary zones by the deposition of a masking resin, masking and selectively removing the non-masked zone.

12. A method according to claim 2, wherein said step of depositing said first metallic thin layer interconnects the emitting peaks of said cathodes; and further comprising etching a system of said gates in the second metallic thin layer.

13. A method for making electron sources of field emission devices comprising:

depositing at least one layer of dielectric material on a monocrystalline substrate;

etching at least one cavity in the deposited dielectric layer;

forming a cathode peak having facets, by crystalline growth nucleated on the substrate, at the bottom of each cavity; and forming a layer of electrically conductive material, acting as a gate, on the at least one layer of dielectric material.

14. A method according to claim 13, comprising forming a polycrystalline layer of electrically conductive material during the step of forming the monocrystalline cathode peak.

15. A method according to claim 14, comprising:

using an Si substrate; and forming the layer of electrically conductive material and the cathode peak using a parent gas phase doped and diluted in a carrier gas.

16. A method according to claim 15, wherein the parent gas phase comprises $SiH_4$ and wherein the carrier gas is $H_2$ or He.

17. A method according to claim 15, comprising adding HCl in the gas phase.

18. A method according to claim 15, comprising using $PH_3$ as a dopant gas.

19. A method according to claim 13, comprising forming the at least one layer of electrically conductive material on the dielectric layer before etching of the cavity.

20. A method according to claim 19, comprising depositing, on the layer of electrically conductive material, a second layer of dielectric material.

21. A method according to claim 20, comprising the material forming the second dielectric layer being different from the material forming the first dielectric layer, and increasing the size of the cavity in the first dielectric layer by selective chemical attack.

22. A method according to claim 21, comprising said first dielectric layer being $SiO_2$, and the selective chemical attack being achieved by HF.

23. A method according to claim 19, comprising forming the cathode peak under conditions of faceted, selective epitaxy.

24. A method according to claim 23, comprising said substrate being made of Si, and achieving the selective epitaxy in a CVD reactor at a temperature ranging from 900° to 1100° C. and using a gas mixture consisting of $SiH_4$+HCl or $SiH_2Cl_2$+HCl in carrier hydrogen.

25. A method according to claim 23, comprising the substrate being GaAs, and performing the selective epitaxy between 600° and 800° C. in a VPE reacting using a gas mixture comprising $AsCl_3$ diluted in $H_2$ and a solid gallium source.

26. A method according to claim 23, comprising the substrate being GaAs, and performing the selective epitaxy in a reduced pressure MOCVD reactor.

27. A method according to claim 20, comprising moving the second layer of dielectrical material by selective chemical attack.

28. A method according to claim 13 comprising, when the facets of the cathode peak are not formed in predetermined crystallographic planes, subjecting the peak to a subsequent selective chemical attack to obtain facets of the cathode peak in the predetermined crystallographic planes.

29. A method according to claim 28, comprising the substrate being made of Si, and using, for the subsequent selective chemical attack, a solution based on hydroxide ions, such as KOH or NaOH.

30. A method according to claim 28, comprising using, for the subsequent selective chemical attack, an ethylenediamine-based solution.

31. An electron source of the field emission type comprising, in the order given, a monocrystalline substrate with at least one projecting cathode peak formed by faceted epitaxial growth nucleated on the substrate, a dielectric layer and a layer of electrically conductive material, the cathode peak being housed in a cavity, with a section of any shape, made in these two layers and being centered with respect to the aperture in the conducting layer.

32. A component using an electron source according to claim 31.

33. A component according to claim 32, wherein the component is an electroluminescent component having an anode layer made of an electroluminescent material enclosing the cavity at the bottom of which the cathode peak has been formed.

34. A component according to claim 32, having a matrix structure of rows and columns, each intersection of the matrix including at least one electron source.

* * * * *